US008250679B1

(12) United States Patent
Fariña

(10) Patent No.: US 8,250,679 B1
(45) Date of Patent: Aug. 28, 2012

(54) PLUNGER APPARATUS

(76) Inventor: Manuel Fariña, Miami, FL (US)

( * ) Notice: Subject to any disclaimer, the term of this patent is extended or adjusted under 35 U.S.C. 154(b) by 847 days.

(21) Appl. No.: 12/175,059

(22) Filed: Jul. 17, 2008

(51) Int. Cl.
*E03D 9/00* (2006.01)

(52) U.S. Cl. ..... 4/255.05; 4/255.06; 4/255.09; 4/255.11

(58) Field of Classification Search ..... 4/255.01, 4/255.04–255.06, 255.09, 255.11; 134/184, 134/169 R; 137/15.05, 240
See application file for complete search history.

(56) References Cited

U.S. PATENT DOCUMENTS

| | | | | | |
|---|---|---|---|---|---|
| 2,535,092 | A | * | 12/1950 | Rettinger | 4/255.05 |
| 2,697,842 | A | * | 12/1954 | Meyer | 4/255.02 |
| 2,733,450 | A | * | 2/1956 | Wallace, Sr. | 4/255.06 |
| 4,756,480 | A | | 7/1988 | Fish | |
| 4,768,237 | A | | 9/1988 | Torti | |
| 4,847,923 | A | * | 7/1989 | Huang | 4/255.03 |
| 5,020,166 | A | | 6/1991 | Davenport | |
| 5,421,904 | A | * | 6/1995 | Carlson | 134/22.12 |
| 6,163,895 | A | | 12/2000 | Davenport | |
| 6,295,659 | B1 | * | 10/2001 | Sandness | 4/255.01 |
| 6,393,625 | B1 | * | 5/2002 | Tsai | 4/255.02 |
| 6,510,860 | B2 | * | 1/2003 | Kihs | 134/166 C |
| 6,907,622 | B2 | | 6/2005 | Rasaei et al. | |
| 7,073,211 | B1 | * | 7/2006 | Wu | 4/255.02 |
| 7,340,783 | B2 | * | 3/2008 | Leaphart et al. | 4/255.02 |
| 7,350,824 | B2 | * | 4/2008 | Petner et al. | 285/148.23 |
| 2005/0204461 | A1 | * | 9/2005 | Allenbaugh et al. | 4/255.11 |

* cited by examiner

*Primary Examiner* — David Dunn
*Assistant Examiner* — Danielle Jackson
(74) *Attorney, Agent, or Firm* — Albert Bordas, P.A.

(57) ABSTRACT

A plunger apparatus, comprising a force cup assembly having a top edge, a neck, and a first bottom edge. An elongated connector has a tube comprising a first top end and a first bottom end. A housing assembly has a second top end and a second bottom edge. An adaptor has a third top end and a third bottom edge. A valve assembly comprises a valve and a fitting. The force cup assembly comprises at least one ridge and the second bottom edge rests upon the at least one ridge. In operation, a force is placed upon the valve assembly, thus biasing the second bottom edge against the at least one ridge to cause the first bottom edge to form a seal upon a drain. Flushing means comprise liquid matter entering via the fitting and flowing through the elongated connector and the force cup assembly when the valve is actuated.

14 Claims, 5 Drawing Sheets

PLUNGER APPARATUS

BACKGROUND OF THE INVENTION

1. Field of the Invention

The present invention relates to plungers, and more particularly, to a plunger apparatus for unclogging drains stuck with matter.

2. Description of the Related Art

Sink and toilet drains often become clogged with matter. A variety of plungers have been developed in the past. None of them, however, include the novel features of the present invention.

Applicant believes that one of the closest references corresponds to U.S. Pat. No. 4,756,480, issued to Fish, on Jul. 12, 1988 for Apparatus for Flushing Drains. However, it differs from the present invention because Fish teaches a drain unclogging and clearing apparatus providing an elongated rigid tube having a constricting nozzle at one end capable of increasing the velocity of water flowing through the tube and ejecting such water in a jet, the nozzle being surrounded by a flared resilient splash guard. The opposite end of the tube is provided with a quick acting manually controlled ball plug valve connected to a supply hose, which, in turn, is connectable to either a male or female threaded faucet. An oval ring-shaped handle is adjustably mounted on the tube approximately one-third of the length of the tube from the valve and is provided with studs for carrying male and female hose adapters.

Applicant believes that another reference corresponds to U.S. Pat. No. 2,733,450 issued to Wallace, Sr. on Feb. 7, 1956 for Apparatus for Opening Clogged Drains. However, it differs from the present invention because Wallace, Sr. teaches an apparatus for opening clogged drains, which moves an obstruction through a drain by the hydraulic pressure of a water main or by a creased pressure if the pressure of the main is insufficient to dislodge the obstacle. The patented hydraulic pressure booster device, in combination with an open ended cylinder, has connecting portions of different diameters, a differential piston within the cylinder for reciprocal movement therein having a short continuous head portion disposed within the larger cylinder portion and a longer stem portion for movement within the smaller cylinder portion, an open ended continuation of the smaller cylinder portion extends a substantial distance outward beyond the limit of the path of movement of the piston stem portion, a scaling member mounted on the exterior of said cylinder continuation, adjacent the outer end thereof for engagement within an opening in a receptacle, which receives hydraulic pressure from the smaller cylinder portion through the continuation thereof, a water inlet on the periphery of said smaller cylinder continuation beyond the path of movement of the piston stem admitting water to the smaller cylinder portion and the continuation thereof, a conduit connecting the water inlet to a water supply line, a check valve in said conduit preventing water flow from the cylinder and its continuation to the water supply line, a closure for the open end of the larger cylinder portion, a water inlet in said closure member, a conduit connecting the latter water inlet to the water supply line, and a manually operable valve in the latter conduit for selectively admitting water to the larger cylinder portion and draining water therefrom providing reciprocation of the piston under water pressure from the water supply line.

Applicant believes that another reference corresponds to U.S. Pat. No. 5,020,166 issued to Davenport on Jun. 4, 1991 for Multi-purpose Water Pressure Plunger. However, it differs from the present invention because Davenport teaches a multi-purpose water pressure plunger that employs a source of pressurized water to dislodge clogs in bathroom drainage pipes and the like. The plunger is fashioned of a resilient cone-shaped cup, a rigid handle, an adjustable valve, and a means of connection to a pressurized source of water. Sealing against and partially extending into a drain opening, the cup permits full thrust of pressurized water into a drainage pipe without a backflow of water. The cup consists of an upper, deformable portion, and a solid, occlusive bottom portion defining a nipple-shaped end. A flow of pressurized water is supplied to the cup through an elongated and ridged handle with a lengthwise aperture therethrough. An adjustable valve including a ball component and a regulating lever controls the flow of water into the handle, and thus, to the clogged drain. For oddly-shaped and rounded drainage openings, the multi-purpose water pressure plunger has a sealing attachment including a compressible cup having a barrel-like bottom and an occlusive semi-spherical disc. When inserted, the barrel-like bottom partially extends into a drainage opening, and when pressed downwardly, the semi-spherical disc seals the barrel-like bottom against walls of a drainage opening, and the perimeter of the compressible cup envelopes around the barrel-like bottom.

Applicant believes that another reference corresponds to U.S. Pat. No. 4,768,237 issued to Torti on Sep. 6, 1988 for Toilet Plunger. However, it differs from the present invention because Torti teaches a toilet plunger comprising a resiliently deformable plunger element, a tubular handle element which is connectable to a supply of pressurized water, a shutoff valve on the handle element, and a check valve element for preventing the inadvertent backflow of fluids through the handle element. The toilet plunger is operable for applying increased pressure to an obstruction in the outlet portion of a toilet or in a drain line by supplying pressurized water to the plunger element through the tubular handle element, and it is alternatively operable as a conventional toilet plunger by positioning the plunger element over the outlet portion of the toilet or drain line and reciprocally moving the handle element toward and away from the plunger element. The check valve element prevents the backflow of fluids through the handle element in the event that the shutoff valve is inadvertently left in an open position when the plunger is reciprocally operated as a conventional toilet plunger.

Applicant believes that another reference corresponds to U.S. Pat. No. 6,163,895 issued to Davenport on Dec. 26, 2000 for Plunger Apparatus. However, it differs from the present invention because Davenport teaches a multi-purpose water pressure plunger having an adjustable valve with a regulating lever that is attached to a handle. The handle is connected to an anti-backflow valve. The anti-backflow valve is removably connected to a plunger head that is made of a soft, pliable material that can easily deform to a desired shape so as to form a seal within a drain or pipe.

Applicant believes that another reference corresponds to U.S. Pat. No. 6,907,622 issued to Rasaei, et al. on Jun. 21, 2005 for Flushing Device for Toilets. However, it differs from the present invention because Rasaei, et al. teaches a flushing device for toilets that includes a source for applying a fluid pressure to a blockage area and provides a seal in the blocked conduit to prevent backflow so that full pressure is applied to the blockage. The device includes a resilient, deformable and expandable element secured at the end of a tubular member, which is inserted into a toilet conduit leading to the drain line. The tubular member has a coupling at its end opposite to the end carrying the expandable element to which a hose is connected in order to alternately supply pressurized water to the element or to the conduit. The expandable element is carried on a linear portion of the tubular member adjacent to the discharge orifice thereof and is expanded into a sealing condition with the conduit entrance leading into the drain line. The exterior surface of the expandable element is provided with spaced-apart ridges and grooves that are deformable to provide a positive sealing relationship with the entrance of the conduit so as to completely seal the entrance. A valve mechanism is disposed between the tubular member and a pipe connected to the element for user selection of fluid supply to either the element or to the drain conduit.

Other patents describing the closest subject matter provide for a number of more or less complicated features that fail to solve the problem in an efficient and economical way. None of these patents suggest the novel features of the present invention.

SUMMARY OF THE INVENTION

The instant invention is a plunger apparatus, comprising a force cup assembly having a top edge, a neck, and a first bottom edge. It also comprises an elongated connector having a tube. The tube comprises a first top end and a first bottom end. It also comprises a housing assembly having a second top end, and a second bottom edge. It also comprises an adaptor having a third top end and a third bottom edge. It also comprises a valve assembly comprising a valve and a fitting.

The force cup assembly comprises at least one ridge and the second bottom edge rests upon the at least one ridge. In operation, a predetermined force is placed upon the valve assembly, thus biasing the second bottom edge against the at least one ridge to cause the first bottom edge to form a seal around a drain. The valve assembly also has flushing means. The flushing means comprises liquid matter entering via the fitting and flowing through the elongated connector and the force cup assembly when the valve is actuated. The valve assembly further comprises at least one plug to establish an air cavity and cause turbulence within the valve assembly when the liquid matter enters via the fitting and flows through the elongated connector and the force cup assembly when the valve is actuated.

In the preferred embodiment, the first bottom end is fixedly mounted and secured into the force cup assembly, the adaptor is fixedly mounted and secured into the housing assembly, and the valve assembly is fixedly mounted and secured onto the elongated connector. The first bottom end comprises a first exterior diameter that is smaller than a first interior diameter of the top edge to fixedly mount and secure the elongated connector into the force cup assembly. The third bottom edge comprises a second exterior diameter that is smaller than a second interior diameter of the second top end to fixedly mount and secure the adaptor into the housing assembly. The valve assembly comprises a third interior diameter that is larger than a third exterior diameter of the first top end to fixedly mount and secure the valve assembly onto the elongated connector.

It is therefore one of the main objects of the present invention to provide a plunger apparatus that unclogs drains stuck with matter.

It is another object of this invention to provide a plunger apparatus that unclogs drains stuck with matter without resorting to chemicals.

It is another object of this invention to provide a plunger apparatus that unclogs drains stuck with matter by solely using liquid matter force, from a liquid matter source, such as a water hose.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
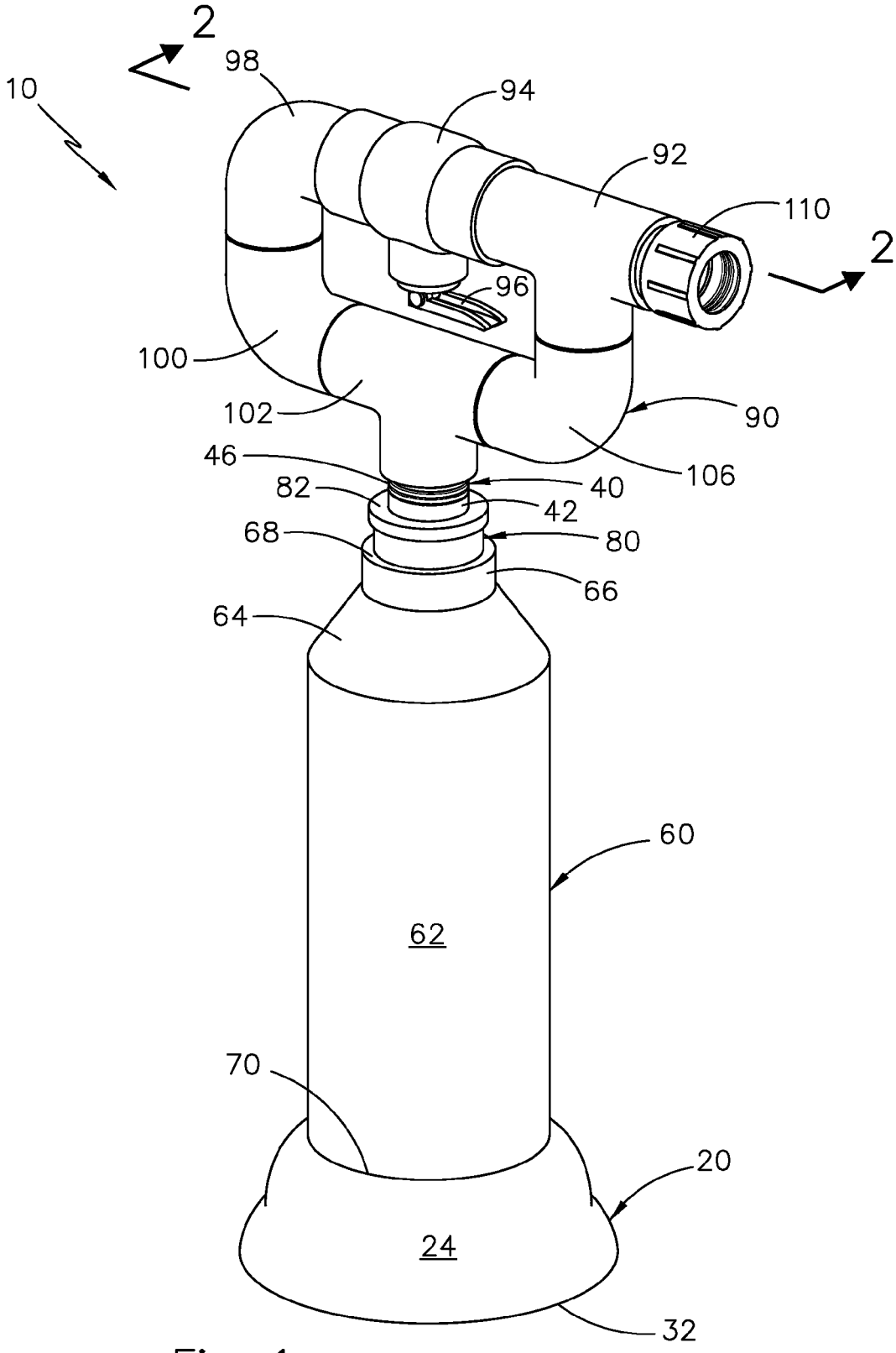
FIG. 1 represents an isometric view the instant invention without the accessory bowl assembly.

Referring now to the drawings, the present invention is generally referred to with numeral 10.

As seen in FIG. 1, instant invention 10 basically includes force cup assembly 20, elongated connector 40, housing assembly 60, adaptor 80, valve assembly 90, and accessory bowl assembly 120. Housing assembly 60 comprises housing 62, frustroconical portion 64, neck 66, top end 68, and bottom edge 70. Housing 62 has a substantially cylindrical shape.

Figure 2:
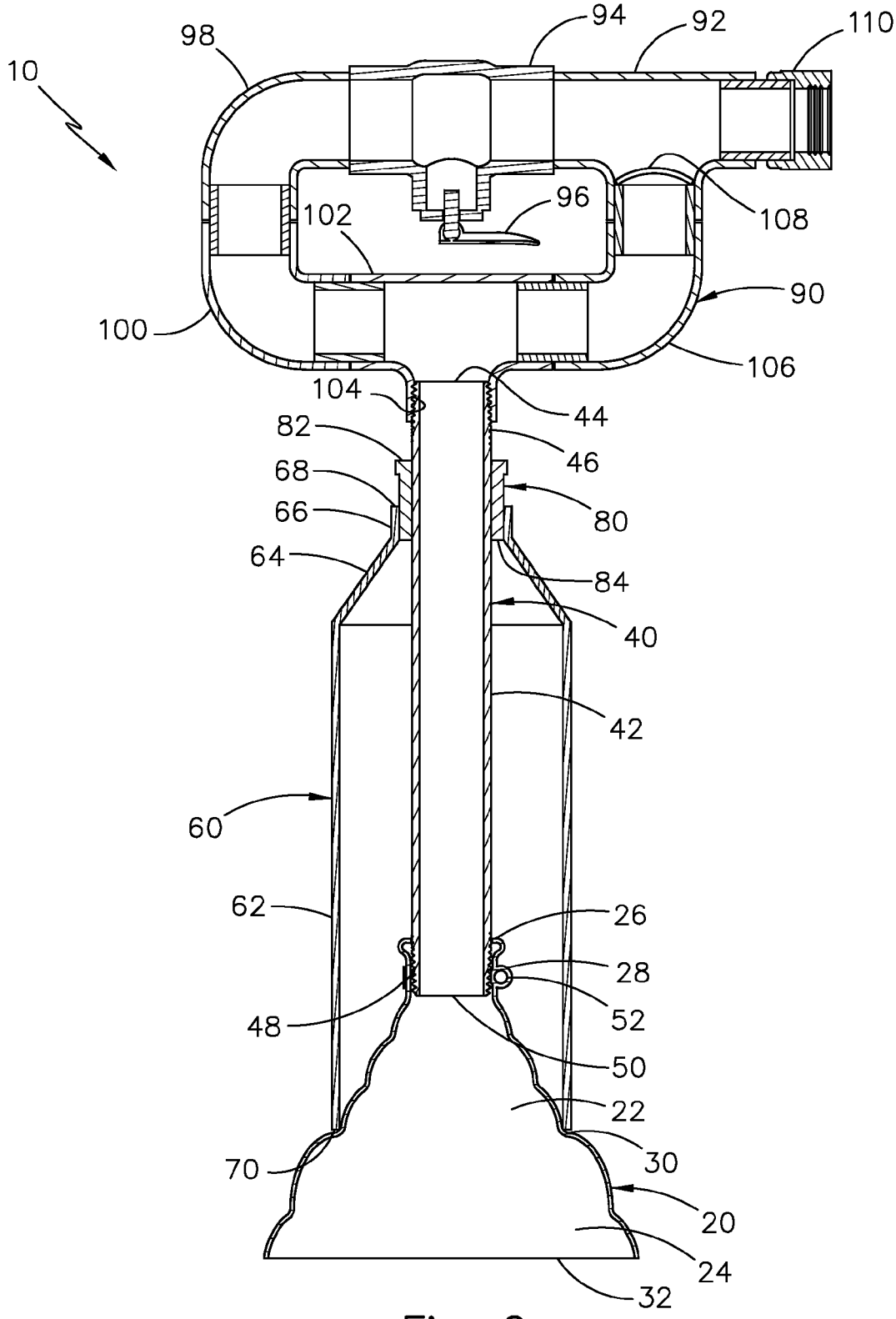
FIG. 2 is a cross-section view taken along lines 2-2 as illustrated in FIG. 1 when the valve is not actuated.
Figure 3:
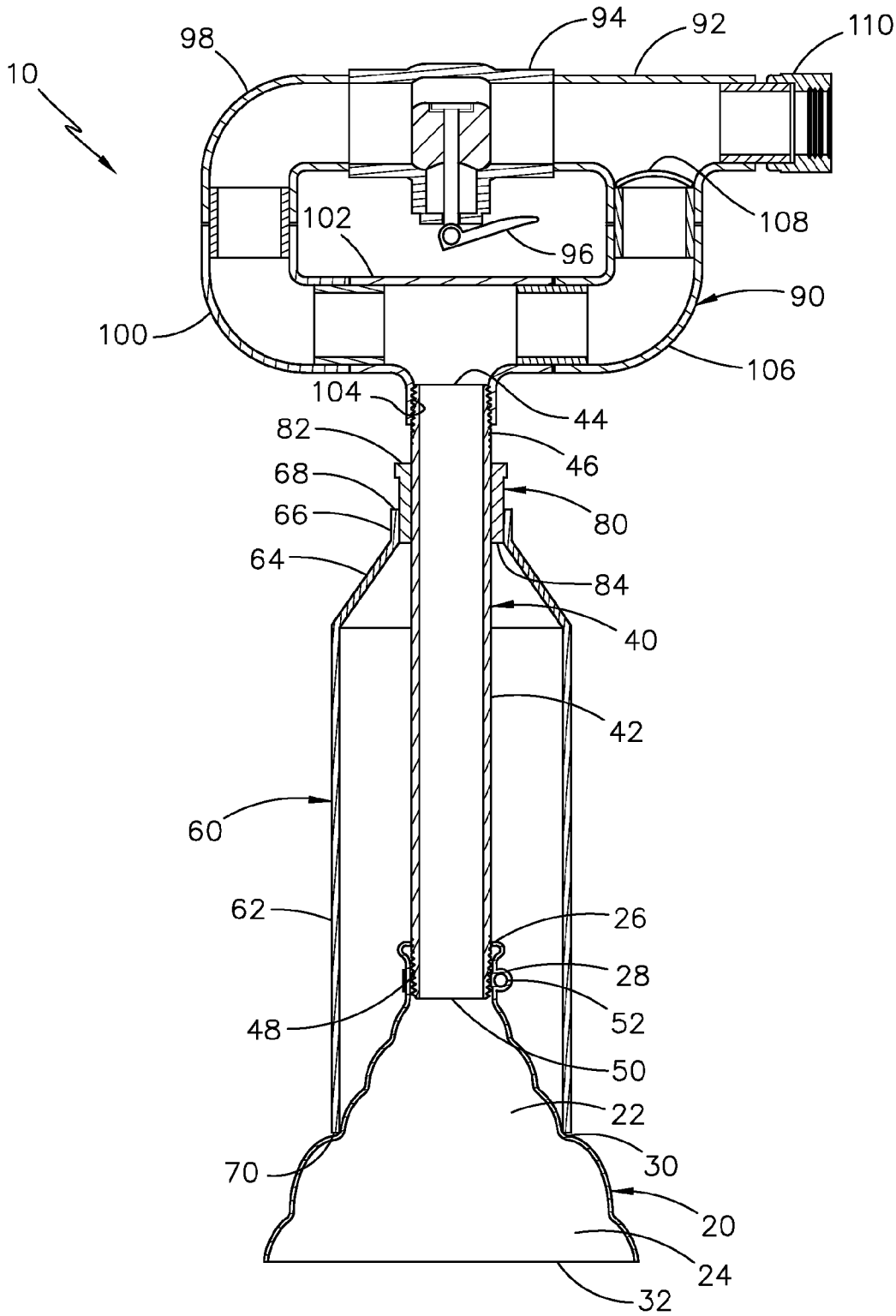
FIG. 3 is a cross-section view as represented FIG. 2, but with the valve actuated.

As better seen in FIGS. 2 and 3, force cup assembly 20 comprises upper section 22 and lower section 24. Upper section 22 has neck 28 that terminates at top edge 26. Ridge 30 divides upper section 22 from lower section 24. Upper section 22 is housed within housing 62 and bottom edge 70 rests upon ridge 30, which has a cooperative dimension and shape. Lower section 24 terminates at bottom edge 32.

Elongated connector 40 has a tubular shape and is substantially housed within housing 62. Elongated connector 40 comprises tube 42 having top end 44 and bottom end 50. Threaded portion 46 extends from top end 44. Threaded portion 48 extends from bottom end 50. Top end 44 protrudes from top end 68 of housing assembly 60. Bottom end 50 is mounted to neck 28 of force cup assembly 20. Clamp 52 clamps neck 28 to threaded portion 48.

Adaptor 80 has external dimensions and shape to be snugly mounted to neck 66 of housing assembly 60. Internally, adaptor 80 has cooperative dimensions and shape to snugly receive top end 44 of tube 42. Top end 44, having threaded portion 46 extending therefrom, protrudes from top end 82 of adaptor 80. Adaptor 80 also comprises bottom end 84 mounted within neck 66.

Valve assembly 90 comprises T-connectors 92 and 102, valve 94, and elbows 98, 100 and 106. Fitting 110 is mounted to T-connector 92. Valve 94 is mounted between T-connector 92 and elbow 98. Elbow 100 connects elbow 98 with T-connector 102 and elbow 106 connects T-connector 102 with T-connector 92. Plug 108 is positioned between elbow 106 and T-connector 92. T-connector 102 has interior threading 104. Valve assembly 90 also has flushing means. The flushing means comprises liquid matter, such as water from a water source such as hose H, seen in FIG. 4, entering via fitting 110 and flowing through elongated connector 40 and force cup assembly 20 when valve 94 is actuated at lever 96. Plug 108 establishes an air cavity and causes turbulence within valve assembly 90 when the liquid matter enters via fitting 110 and flows through elongated connector 40 and force cup assembly 20 when valve 94 is actuated is actuated at lever 96.

More specifically, water entering via fitting 110, travels through valve 94 and flows through elbow 98, elbow 100 and T-connector 102 into elongated connector 40. An area within elbow 106, capped by plug 108, defines the air cavity and causes the turbulence within valve assembly 90 when the liquid matter enters via fitting 110 and flows through elongated connector 40 and force cup assembly 20 when valve 94 is actuated is actuated at lever 96.

Figure 4:
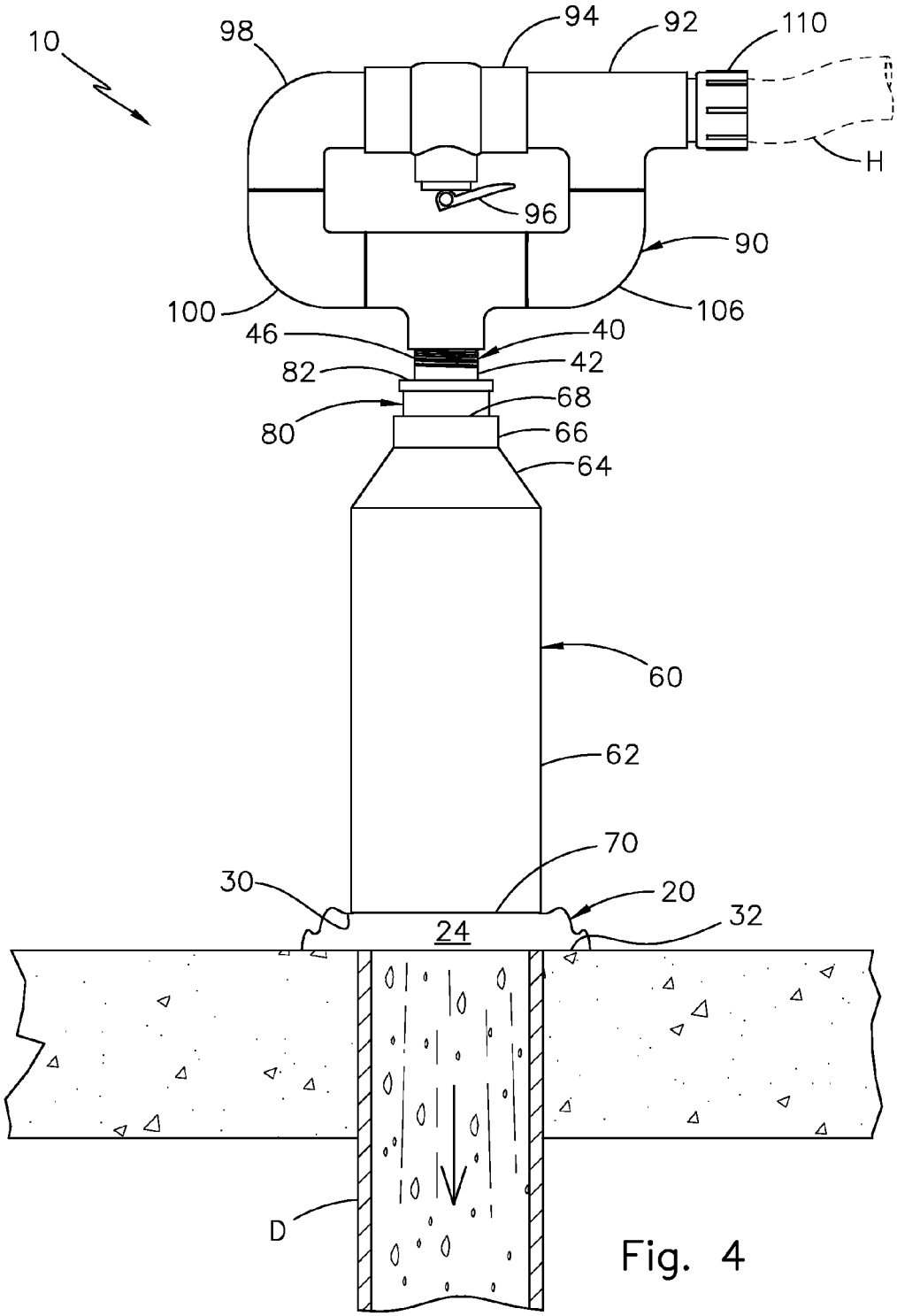
FIG. 4 is a front elevational view of the invention, without the accessory bowl assembly, sealed around a drain and the valve actuated.

In operation, as seen in FIG. 4, a predetermined force is placed upon valve assembly 90, thus biasing bottom edge 70 against ridge 30 to cause bottom edge 32 to form a seal upon drain D. A user then actuates lever 96 to cause the liquid matter from hose H to enter via fitting 110 and flow through elongated connector 40 and force cup assembly 20, to unclog drain D stuck with matter with water force aided by the turbulence defined above.

Figure 5A:
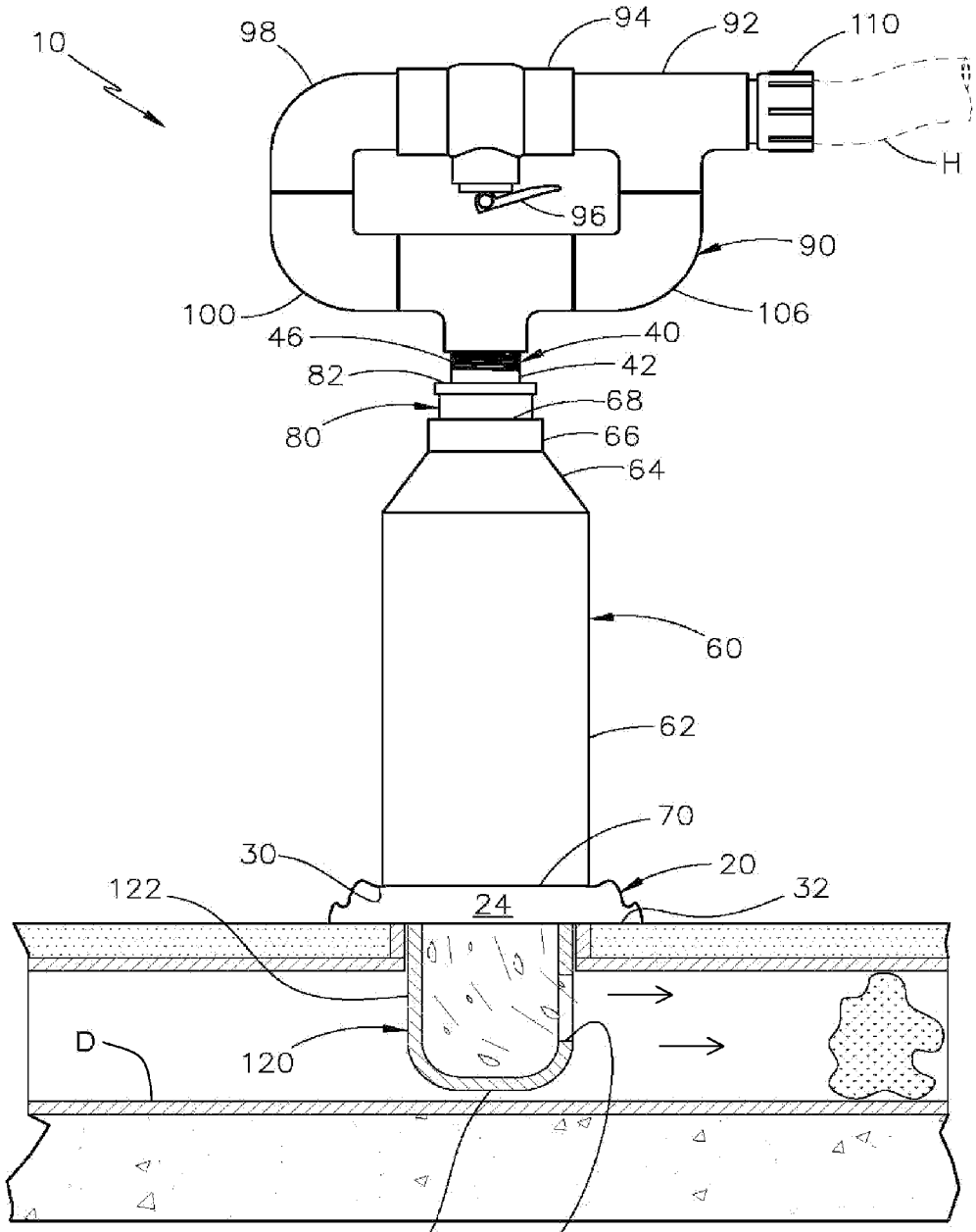
FIG. 5A is a front elevational view of the invention and its accessory bowl assembly sealed around a drain and the valve actuated.
Figure 5:
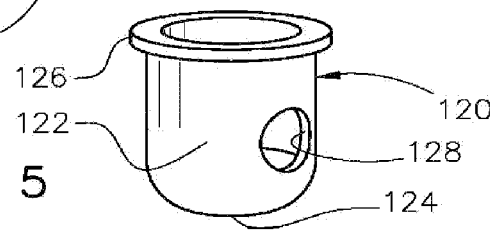
FIG. 5 is an isometric view of the accessory bowl assembly.

As seen in FIG. 5, accessory bowl assembly 120 comprises sidewall 122, base 124, and rim 126. Sidewall 122 has aperture 128 of a predetermined size. In operation, as seen in FIG. 5A, a user positions accessory bowl assembly 120 within drain D, whereby aperture 128 faces the direction of matter within drain D. A predetermined force is placed upon valve assembly 90, thus biasing bottom edge 70 against ridge 30 to cause bottom edge 32 to form a seal upon drain D. A user then actuates lever 96 to cause the liquid matter from hose H to enter via fitting 110 and flow through elongated connector 40, force cup assembly 20, and through accessory bowl assembly 120 to unclog drain D stuck with matter with water force aided by the turbulence defined above.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A plunger apparatus, comprising:

A) a force cup assembly having a top edge, a neck, and a first bottom edge;

B) an elongated connector having a tube, said tube comprising a first top end and a first bottom end, said first bottom end is mounted into said force cup assembly;

C) a housing assembly having a second top end, and a second bottom edge, said housing assembly having a frustroconical portion;

D) an adaptor having a third top end and a third bottom edge, said housing assembly extends from said force cup to said adaptor, and said adaptor is mounted into said housing assembly;

E) a valve assembly comprising a valve and a fitting, said valve assembly is mounted onto said elongated connector; and F) an accessory bowl assembly comprising at least one aperture.

2. The plunger apparatus set forth in claim 1, further characterized in that said force cup assembly comprises at least one ridge.

3. The plunger apparatus set forth in claim 2, further characterized in that said second bottom edge rests upon said at least one ridge.

4. The plunger apparatus set forth in claim 3, further characterized in that a predetermined force is placed upon said valve assembly, biasing said second bottom edge against said at least one ridge to cause said first bottom edge to form a seal upon a drain.

5. The plunger apparatus set forth in claim 1, further characterized in that said valve assembly has flushing means, said flushing means comprising liquid matter entering via said fitting and flowing through said elongated connector and said force cup assembly when said valve is actuated.

6. The plunger apparatus set forth in claim 5, further characterized in that said valve assembly further comprises at least one plug to establish an air cavity and cause turbulence within said valve assembly when said liquid matter enters via said fitting and flows through said elongated connector and said force cup assembly when said valve is actuated.

7. The plunger apparatus set forth in claim 1, further characterized in that said first bottom end comprises a first exterior diameter that is smaller than a first interior diameter of said top edge to fixedly mount and secure said elongated connector into said force cup assembly.

8. The plunger apparatus set forth in claim 7, further characterized in that said third bottom edge comprises a second exterior diameter that is smaller than a second interior diameter of said second top end to fixedly mount and secure said adaptor into said housing assembly.

9. The plunger apparatus set forth in claim 8, further characterized in that said valve assembly comprises a third interior diameter that is larger than a third exterior diameter of said first top end to fixedly mount and secure said valve assembly onto said elongated connector.

10. A plunger apparatus, comprising:

A) a force cup assembly having a top edge, a neck, a first bottom edge, and at least one ridge;

B) an elongated connector having a tube, said tube comprising a first top end and a first bottom end, said first bottom end is fixedly mounted and secured into said force cup assembly;

C) a housing assembly having a second top end, a second bottom edge, and a frustroconical portion;

D) an adaptor having a third top end and a third bottom edge, said housing assembly extends from said force cup to said adaptor, and said adaptor is fixedly mounted and secured into said housing assembly;

E) a valve assembly comprising a valve and a fitting, said valve assembly is fixedly mounted and secured onto said elongated connector; and F) an accessory bowl assembly comprising at least one aperture.

11. The plunger apparatus set forth in claim 10, further characterized in that said second bottom edge rests upon said at least one ridge.

12. The plunger apparatus set forth in claim 11, further characterized in that a first predetermined force is placed upon said valve assembly, biasing said second bottom edge against said at least one ridge to cause said first bottom edge to form a seal upon a drain.

13. The plunger apparatus set forth in claim 12, further characterized in that said valve assembly has flushing means, said flushing means comprising liquid matter entering via said fitting and flowing through said elongated connector, said force cup assembly, and said accessory bowl assembly when said valve is actuated.

14. The plunger apparatus set forth in claim 13, further characterized in that said valve assembly further comprises at least one plug to establish an air cavity and cause turbulence within said valve assembly when said liquid matter enters via said fitting and flows through said elongated connector and said force cup assembly when said valve is actuated.

* * * * *